United States Patent [19]

Jergenson

[11] 4,318,029

[45] Mar. 2, 1982

[54] LIQUID METAL ION SOURCE

[75] Inventor: Jerg B. Jergenson, Santa Barbara, Calif.

[73] Assignee: Hughes Aircraft Company, Culver City, Calif.

[21] Appl. No.: 148,851

[22] Filed: May 12, 1980

[51] Int. Cl.[3] ..... H01J 27/02

[52] U.S. Cl. ..... 315/111.81; 250/423 R; 313/232; 313/362.1

[58] Field of Search ..... 315/111.8; 313/163, 313/230, 231, 232, 362; 250/288, 423 R, 425

[56] References Cited

U.S. PATENT DOCUMENTS

| | | | |
|---|---|---|---|
| 3,233,404 | 2/1966 | Huber et al. | 313/362 X |
| 3,475,636 | 10/1969 | Eckhardt | 313/163 X |
| 4,088,919 | 5/1978 | Clampitt et al. | 313/232 X |

*Primary Examiner*—Eugene R. La Roche

*Attorney, Agent, or Firm*—Allen A. Dicke, Jr.; W. H. MacAllister

[57] ABSTRACT

Liquid metal ion source has cylindrical ceramic tube 12 embraced by strip heater 20 which is held in place by ceramic bushing 26. Apex 28 of the strip heater contains the ion source fuel metal and is pierced by needle 34 having sharp tip 36. Upon heating and electrical bias with respect to a coaxial extraction electrode, tip 36 emits ions.

11 Claims, 3 Drawing Figures

LIQUID METAL ION SOURCE

The government has rights in this invention pursuant to Contract No. N-00123-78C-0195 awarded by the U.S. Navy.

BACKGROUND OF THE INVENTION

This invention is directed to a field emission liquid metal ion source which has a needle which is heated and is coated with liquid metal to emit ions.

The liquid metal ion source is a relatively new device. Several liquid metal ion sources have been made in the recent past, and those designed by Roy Clampitt and L. W. Swanson are of particular interest. The Roy Clampitt source is disclosed in United Kingdom Pat. No. 1,442,998 discussed below and in several papers: R. Clampitt and D. K. Jefferies, "Miniature Ion Sources for Analytical Instruments", *Nuclear Instruments and Methods,* 149, (1978), pp. 739–742; and R. Clampitt and D. K. Jefferies, "Molten Metal Field Ion Sources", *Institute for Physics Conference,* Series No. 38 (1978), Chapter 1, pp. 12–17. Swanson's work was presented as "Emission Characteristics of a Liquid Gallium Ion Source" at SEM/1979, Apr. 16–20, 1979 at Washington, D. C. by L. W. Swanson, G. A. Schwind and A. E. Bell.

Most liquid metal ion sources to date have employed metals or alloys possessing low melting points. Gallium, indium, bismuth and cesium are examples of metals which have been used in such sources. Nearly all prior liquid metal ion sources are characterized by a solid or tubular needle protruding from a closed reservoir, and the reservoir is used for holding the liquid metal. Liquifying the metal has usually been done by heating the reservoir indirectly, either radiantly or conductively. United Kingdom Pat. No. 1,442,998 shows a plurality of adjacent field emission points to which liquid ion source material is fed by capillary action.

There are considerable disadvantages to these prior art structures, particularly when they are employed with metals or alloys which have melting points higher than those listed above. These disadvantages include the fact that they are time consuming to manufacture and as a result are expensive to the user. Furthermore, the reservoirs are impossible to refill and thus a new ion source is required whenever the reservoir is exhausted. The needle is inefficiently heated and the desired temperature gradient is hard to achieve. The direct heating of the needle tip by backstreaming secondary electrons is hard to detect.

The gas field ionization "hairpin" ion source when used with a liquid metal, was initially thought to offer solutions to some of those problems. The heart of the hairpin device is a U-shaped heater wire with a needle welded to the apex of the U. The heater wire was used to clean the attached needle by heating it to cause outgasing. The device was originally designed for gas field emission. L. W. Swanson first used the device as a liquid metal source, by applying liquid metal directly to the needle, but a number of drawbacks were found. The hairpin device is difficult to make, due to the necessary welding of the needle to the U-shaped heater wire. Since the needle is welded to the wire, the device lacks versatility because the amount of needle protrusion beyond the heater wire is fixed. Since the needle is mounted on the heater wire, and the heater wire is employed for structural support of the needle, the ion source lacks stability in the direction perpendicular to the plane of the U-shaped heater wire when the heater wire is heated. As a result there is need for an improved field emission liquid metal ion source.

SUMMARY OF THE INVENTION

In order to aid in the understanding of this invention it can be stated in essentially summary form that is directed to a liquid metal ion source wherein a field emission needle is fixed in an insulator, and a generally V folded flat elongated heater strip is mounted around the tip with a tip extending through a perforation in the heater strip. The heater strip is clamped to the outside of a mounting tube and is folded adjacent its V tip fold to provide stability and heater strength.

It is thus an object of this invention to provide a liquid metal ion source which relies on a field emission sharp needle to cause ion emission into an electric field, with the needle supported in the module, together with a ribbon foil heater strip V folded and enbracing the needle adjacent its point so that the point is almost directly heated. It is another object of this invention to provide a liquid metal ion source with a field emission point which is of such construction that the point protrusion beyond the heater is readily established and is adjustable. It is a further object to provide a liquid metal ion source of the field emission needle type which is economic of construction as well as of strong construction so that is may be easily manufactured, readily available and conveniently used. It is another object to provide a liquid metal ion source wherein the needle has sufficient structural stability so that the needle point excursions from axis are minimal at operating temperatures thereby allowing its use in a microprobe structure. It is another object to provide a liquid metal ion source with an open reservoir (i.e., heater) construction so that additional metal can be placed in the reservoir for continued use.

Other objects and advantages of this invention will become apparent from a study of the following portion of this specification, the claims and the attached drawings.

DESCRIPTION OF THE PREFERRED EMBODIMENT

Figures 1, 2, 3:
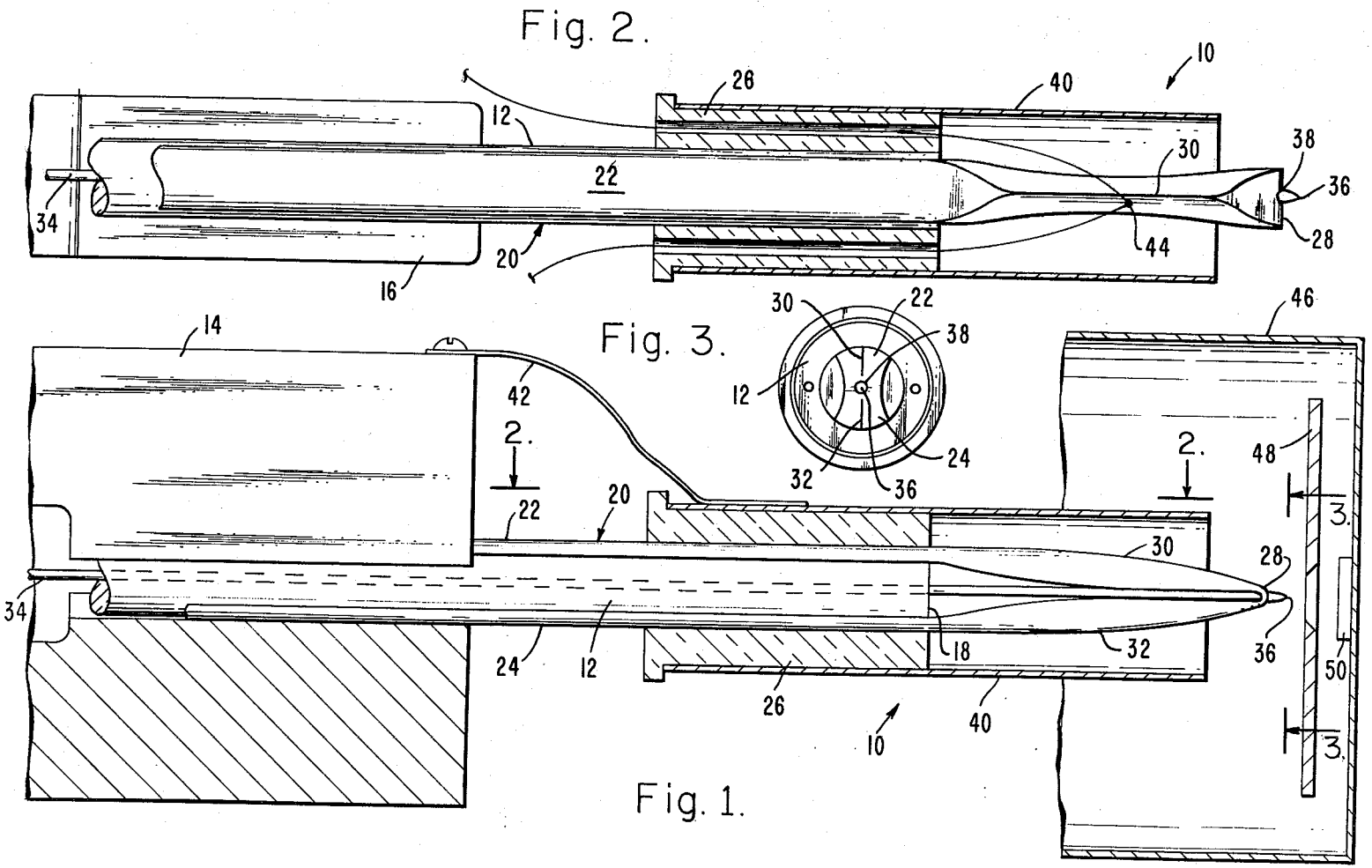
FIG. 1 is side elevational view of the liquid metal ion source of this invention, with parts broken away and parts taken in section.
FIG. 2 is plan view of the ion source, as seen generally along line 2—2 of FIG. 1, with parts removed and other parts broken away and taken in section.
FIG. 3 is a front elevational view of the needle tip structure, as seen generally along lines 3—3 of FIG. 1.

The liquid metal ion source of this invention is generally indicated in 10 in FIGS. 1 and 2. Its principal structural body part is ceramic tube 12 which is clamped in clamp blocks 14 and 16 to hold the liquid metal ion source in place. Ceramic tube 12 extends forward to face 18. An etched and formed metal strip heater 20 is doubled over to provide two legs 22 and 24 which are embraced around the top and bottom of ceramic tube 12 is seen in FIG. 1. The heater legs 22 and 24 are held onto tube 12 by the clamp blocks 14 and 16 to provide support for them and also to provide electrical connection to the heater legs. Furthermore, the strip heater 20 is held onto ceramic tube 12 by means of ceramic bushing 26 which clamps the heater legs in place. Preferably, the ceramic bushing extends substantially as far to the right as face 18 of tube 12.

Strip heater 20 is made of a formable metal strip material which is compatible with the fuel material from which the ions are extracted. Tungsten, molybdenum and nickel are suitable materials. The center portion of the heater strip, near its apex 28 where the heater strip is folded, may be thinned by electroetching, or similiar techniques to tailor the thermal characteristics of the heater strip in the apex region.

In order to improve the structural strength of the heater strip where it has no support between face 18 and apex 28, the heater strip is creased in an embossing die. Fold lines 30 and 32 show the longitudinal folds in the legs 22 and 24, respectively. A V shaped fold, is indicated in FIGS. 1, 2 and 3, is usually sufficient, but where the heater strip is wide at the apex, additional creases could be employed. At the same time the V shaped creases are embossed in the free portion of the heater strip, the heater strip can be cylindrically shaped to fit the exterior of ceramic tube 12, at least in the area under clamp blocks 14 and 16 and bushing 26.

Needle 34 extends through the central opening in ceramic tube 12 and its tip 36 protudes through hole 38 in the apex 28 of the heater tube. Needle 34 can be made of the same material as heater strip 20. The hole 38 is such that the apex engages against the needle 34 just behind its needle tip 36 to provide omindirectional support for the needle while not restraining it axially. With the folding of the extended portion of the strip heater, lateral strength is improved and with the engagement on needle 34, the folding enhances columnar strength along the axis of the needle. Hole 38 may be perforated or drilled, and while the heater strip engages upon the needle, the hole must be irregular to provide for liquid metal flow around the needle from the interior of the folded apex 28 to the needle tip 36. Another reason for physical engagement of the strip heater on the needle is that when the structure is heated, with resultant thermally caused dimensional changes, the needle must remain in the same position with respect to the heater, and physical engagement assures this condition. A triangular hole would provide both for the physical interference fit and the flow passages through the hole 38.

After the heater and needle are assembled and cleaned, heat and evaporation shield 40 is put in place. Shield 40 may be single or multilayered, as temperature requirements dictate. The choice of materials for construction of shield 40 is not as stringent as the materials for the needle and heater. It must be made of metal so that it can be biased but metals exhibiting high reactability with the reservoir material should be avoided. Shield 40 is electrically connected to block 14 by strap 42.

Thermocouple 44 is attached to strip heater 20 behind its apex 28 by spot welding or mechanical means. The thermocouple leads pass rearward through clearance holes in the ceramic bushing 26 and thence to their attachment terminals. In this way heater temperature can be monitored.

Liquid metal ion source 10 is mounted in a vacuum vessel 46 which contains extractor electrode 48 having a central opening. Target 50 is positioned beyond the extractor electrode. The target 50 may be any ion beam utilization device. Module 10 is adjustable in its clamp blocks 14 and 16 so that the distance from apex 28 to extraction electrode 48 can be adjusted. Furthermore, needle 34 can be axially adjusted within tube 12 so that the amount of protrusion of its needle tip 36 beyond the apex 28 can be controlled.

In use, the liquid metal ion source has a vacuum applied thereto and current is applied to strip heater 20 so that the source is cleaned by evaporation. After the cleaning, a small amount of powdered, granular or short lengths of strip metal or alloy is inserted within the fold of the strip heater behind the apex 28 and around needle 34. This is the fuel metal which forms the source of the ions in the liquid metal ion source. Upon heating in vacuum, the fuel metal forms a meniscus within the fold of the apex 28. The meniscus is symmetrical with the center line of the device. At a temperature somewhat higher than the melting point of the fuel material, the fuel material will wet the needle 34 just inside the apex and will flow by surface tension forces out through hole 38 to needle tip 36. After the cleaning, fusing and wetting procedures is complete, heat and evaporation shield 40 is put in place.

Ion are extracted from needle tip 36 when strip heater 20 is heated to a temperature somewhat past the melting point of the fuel material and a sufficiently high voltage is applied between needle 36 and extractor electrode 48. Usually, the extractor is near or at ground potential and needle 34 is biased positive to a value depending upon the fuel material and the desired current. A bias voltage of about +6 to 10 kV with gold-germanium as a fuel material and with the heater at 370° C., will result in a current of 5 to 150 microamperes. The amount of current flowing through the opening in extractor electrode 48 depends upon the spacing between the needle tip 36 and the extractor electrode as well as the amount of electric field applied and to a somewhat larger extent on the heat temperature. Current can be drawn as long as the fuel metal remains, and the fuel metal can be resupplied as required, at shut downs of the ion source. Ion source 10 can use the usual low melting point conventional materials as fuel materials, including gallium, indium, bismuth and cesium. In addition to those materials, the present liquid metal ion source 10 can also employ gold germanium, gold silicon, tin, tin aluminum and gold as fuel materials. An inportant feature of the liquid metal ion source 10 is that the fuel material is easily refilled due to the open design on the heater strip. Fuel material in liquid, powder, granular or strip form can be used. Similiarly, due to the open design of the heater, the structure can be easily cleaned by evaporation, in the vacuum chamber and by heating. The old fuel material can be evaporated away and a different fuel material installed, so that even though the ion source 10 has been previously used, its ion supply material can be changed.

The liquid metal ion source 10 is compact in design and possesses considerable structural stability due to the creased and formed legs of the heater strip. Since the ceramic tube 10 which serves as a basic structural element is uniform, it is adjustable along the center line so that the needle tip to extractor electrode spacing can be varied, and the structure is such where engagement or mounting of the ion source is easily accomplished, including electrical connections to the heater for heating and bias thereof as well as electric bias connections to needle 34.

Because the apex of the needle is thermally isolated, and not having a major thermal transfer path, it has low thermal inertia. As a result of this, the heater requires little power, but there is an additional advantage that heating due to electron bombardment by secondary emission can be detected by means of the heater thermocouple 44. In this way, over heating is avoided. The result is a liquid metal ion source 10 which is inexpensive to build and operate, is useful with any wide variety of fuel material, which can be changed, and the ion source can be easily adjusted, operated and controlled.

This invention has been described and its presently contemplated best mode and it is clear that is susceptible to numerous modifications, modes and embodiments within the ability of those skilled in the art and without the exercise of the inventive faculty. Accordingly, the scope of this invention is defined by the scope of the following claims.

What is claimed is:

1. A liquid metal ion source comprising:

a tubular body of electrical insulation material, said body having a face and having an opening therethrough from said face;

a strip heater having a folded apex and having first and second legs extending from said apex, said legs being engaged on said tubular body so that said apex is positioned beyond said face, an opening in said strip heater at said apex, said strip heater being made of metallic material and being connectable to a heater electric power supply for electrically heating said strip heater at said apex by current through said strip heater legs;

a metallic needle positioned in said opening through said body and extending beyond said face and extending through said opening in said apex of said strip heater, said needle having a pointed needle tip positioned beyond said apex of said strip heater and against said needle so that liquid metal flows out to said needle point so that ions can be emitted at said needle point from the liquid metal.

2. The liquid metal ion source of claim 1 wherein said insulator tubular body is a cylindrical insulator tube and said legs of said strip heater are engaged on opposite sides of said cylindrical insulator tube.

3. The liquid metal ion source of claim 2 wherein an insulator bushing is positioned around said legs of said heater to clamp said strip heater legs onto said body.

4. The liquid metal ion source of claim 3 wherein a shield is mounted on said bushing and extends forward from said face to surround at least a part of the heater forward of said face of said body.

5. The liquid metal ion source of claim 4 wherein first and second metallic clamp blocks engage upon said heater legs and upon said insulator tube to electrically connect to said heater legs and position said strip heater.

6. A liquid metal ion source comprising:

a tubular body of electrical insulation material, said body having a face and having an opening therethrough from said face;

a strip heater having a folded apex and having first and second legs extending from said apex, said legs being engaged on said tubular body so that said apex is positioned beyond said face, at least a part of each of said heater legs between said face and said apex having a fold line therein to strengthen said heater legs between said face and said apex, an opening in said strip heater at said apex, said strip heater being made of metallic material and being connectable to a heater electric power supply for electrically heating said strip heater at said apex by current through said strip heater legs;

a metallic needle positioned in said opening through said body and extending beyond said face and extending through said opening in said apex, said needle having a pointed needle tip positioned beyond said apex so that fuel metal can be melted within said apex of said strip heater and against said needle so that liquid metal flows out to said needle point so that ions can be emitted at said needle point from the liquid metal.

7. The liquid metal ion source of claim 6 wherein an insulator bushing is positioned around said legs of said heater to clamp said strip heater legs onto said body.

8. The liquid metal ion source of claim 7 wherein a shield is mounted on said bushing and extends forward from said face to surround at least a part of the heater forward of said face of said body.

9. The liquid metal ion source of claim 8 wherein said insulator tube is a cylindrical insulator tube and said legs of said strip heater are engaged on opposite sides of said cylindrical insulator tube.

10. The method of generating an ion beam which comprises the steps of:

(a) forming an apex in a strip of heating material with legs on both sides of the apex and forming an aperture through the strip material at the apex thereof;

(b) supporting the strip heating material with both legs positioned on a ceramic support with the apex protruding beyond the ceramic support;

(c) positioning a needle so that its tip extends through the aperture of the strip heater at the apex;

(d) forming a meniscus of relatively low melting point melted ion source material within the apex of the strip heating material to wet the tip of the needle and;

(e) establishing an electrical potential between the tip of the needle and an extractor to cause ions to flow from the ion source material on the needle tip to the target.

11. The method of claim 10 further including the step of:

forming a protective vacuum between the needle and the target.

* * * * *